US008979561B2

(12) United States Patent
Kerrigan et al.

(10) Patent No.: US 8,979,561 B2
(45) Date of Patent: Mar. 17, 2015

(54) INTERLEAVING EJECTOR LATCHES ENABLING A REDUCED END-TO-END SPACING BETWEEN MEMORY MODULE CONNECTORS

(71) Applicant: International Business Machines Corporation, Armonk, NY (US)

(72) Inventors: Brian M. Kerrigan, Cary, NC (US); Timothy A. Meserth, Durham, NC (US); Tony C. Sass, Fuquay Varina, NC (US); Jean J Xu, Cary, NC (US)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 93 days.

(21) Appl. No.: 13/916,285

(22) Filed: Jun. 12, 2013

(65) Prior Publication Data

US 2014/0370721 A1 Dec. 18, 2014

(51) Int. Cl.
*H01R 13/62* (2006.01)
*H01R 12/71* (2011.01)

(52) U.S. Cl.
CPC ..... *H01R 12/716* (2013.01)
USPC ..... 439/157; 439/327

(58) Field of Classification Search
CPC ..... H01R 13/635; H01R 13/62938; H01R 13/633; H01R 23/7005
USPC ..... 439/153, 157, 160, 327, 328
See application file for complete search history.

(56) References Cited

U.S. PATENT DOCUMENTS 5,181,857 A 1/1993 Layser
5,470,240 A * 11/1995 Suzuki ..... 439/157
5,637,004 A 6/1997 Chen et al.
5,676,561 A * 10/1997 Chiang ..... 439/328
5,746,613 A * 5/1998 Cheng et al. ..... 439/157
5,766,031 A * 6/1998 Yeh ..... 439/328
5,928,015 A * 7/1999 Tondreault ..... 439/157
5,980,282 A 11/1999 Cheng
8,164,894 B2 4/2012 Sun
8,277,235 B2 10/2012 Lu
8,657,612 B2 * 2/2014 Lu ..... 439/160
2012/0135618 A1 5/2012 Shen et al.
2012/0322287 A1 12/2012 Lu

OTHER PUBLICATIONS

IPCOM000157418D: "Space Optimized DIMM Connector"; Publ. Date: Aug. 29, 2007; Authors: IBM; 5 pages.
IPCOM000016116D: "Minimal Footprint Memory Module Connector Latch With Insertion/Removal Force Reduction and Slef-Alignment Features"; Publ. Date: Jul. 3, 2002; Authors: IBM; 3 pages.

* cited by examiner

*Primary Examiner* — Thanh Tam Le
(74) *Attorney, Agent, or Firm* — Katherine S. Brown; Jeffrey L. Streets

(57) ABSTRACT

First and second memory module connectors are secured in end-to-end alignment on a circuit board for receiving memory modules along a central plane. Each memory module connector has an ejector latch pivotally coupled to the adjacent ends of the memory module connectors to pivot about an axis perpendicular to the plane. A distal portion of an upper arm of each ejector latch lies on opposite sides of the plane, such that the ejector latches interleave when either ejector latch is pivoted to an open position. The adjacent ends of the first and second memory module connectors are separated by a narrow gap, such that pivoting of the either ejector latch from a closed position to an open position will push the other ejector latch toward a closed position.

12 Claims, 7 Drawing Sheets

INTERLEAVING EJECTOR LATCHES ENABLING A REDUCED END-TO-END SPACING BETWEEN MEMORY MODULE CONNECTORS

BACKGROUND

1. Field of the Invention

The present invention relates to the ejector latches used with memory module connectors to secure memory modules.

2. Background of the Related Art

Card edge connectors are used in computers and other electronic devices for establishing an electrical connection between a main printed circuit board (PCB) and a supporting PCB. The main PCB may be a motherboard, and the supporting PCB may be a daughter card. For example, a Dual In-line Memory Module (DIMM) card may be received in a DIMM socket connector mounted on a motherboard of a computer or other information technology equipment.

A memory module connector includes a housing having a slot for physically receiving the card and electrical contacts to provide electrical connections between the card and the motherboard. The memory module connector may include an ejector latch is used to latch the memory module in position and assist in removal of the memory module from the connector.

Motherboards will often include multiple memory module connectors. These memory module connectors may be arranged side-by-side in to form a first set, but some motherboards will even have memory module connectors arranged end-to-end. For example, a motherboard may have a first set of memory module connectors arranged side-by-side and a second set of memory module connectors arranged side-by-side, where the memory module connectors in the first set have one end that is directly adjacent and aligned with one end of the memory module connectors in the second set.

For a given motherboard, the memory module connectors are typically arranged to maintain proper airflow for cooling of the memory modules. For example, DIMMs are usually grouped closely together and are oriented parallel to the airflow for optimum cooling and even airflow distribution.

BRIEF SUMMARY

One embodiment of the present invention provides an apparatus comprising a printed circuit board securing first and second memory module connectors in end-to-end alignment, wherein the first memory module connector has a first slot configured to receive a first memory module and the second memory module connector has a second slot configured to receive a second memory module, and wherein the first and second memory modules are centered on a common plane. The first memory module connector has a first ejector pivotally coupled to a first end of the first memory module connector about an axis perpendicular to the plane, wherein the first ejector has an upper arm extending from the pivot axis away from the printed circuit board and a lower arm extending from the pivot axis under the first slot, and wherein a distal portion of the upper arm of the first ejector lies only on a first side of the plane. The second memory module connector has a second ejector pivotally coupled to a second end of the second memory module connector about an axis perpendicular to the plane, wherein the second ejector has an upper arm extending from the pivot axis away from the printed circuit board and a lower arm extending from the pivot axis under the second slot, and wherein a distal portion of the upper arm of the second ejector lies only on a second side of the plane. The first end of the first memory module connector is separated by a narrow gap from the second end of the second memory module connector. Pivoting of the first ejector from a closed position to an open position causes the distal portion of the upper arm of the first ejector to interleave with the distal portion of the upper arm of the second ejector, and pivoting of the second ejector from a closed position to an open position causes the distal portion of the upper arm of the second ejector to interleave with the distal portion of the upper arm of the first ejector.

DETAILED DESCRIPTION

Figure 1:
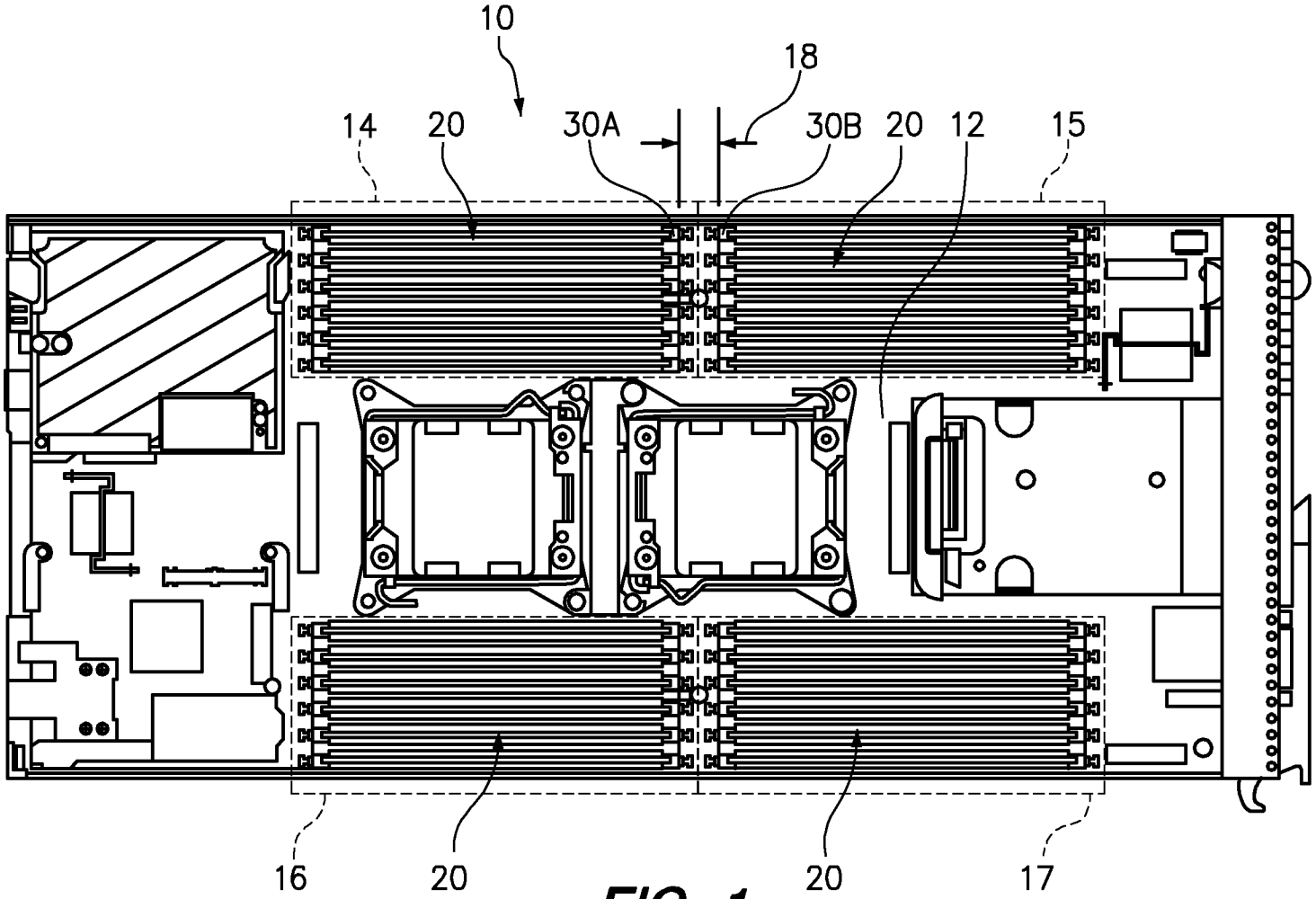
FIG. 1 is a plan view of a server motherboard having memory module connectors arranged side-by-side and end-to-end.

One embodiment of the present invention provides an apparatus comprising a printed circuit board securing first and second memory module connectors in end-to-end alignment, wherein the first memory module connector has a first slot configured to receive a first memory module and the second memory module connector has a second slot configured to receive a second memory module, and wherein the first and second memory modules are centered on a common plane. The first memory module connector has a first ejector pivotally coupled to a first end of the first memory module connector about an axis perpendicular to the plane, wherein the first ejector has an upper arm extending from the pivot axis away from the printed circuit board and a lower arm extending from the pivot axis under the first slot, and wherein a distal portion of the upper arm of the first ejector lies only on a first side of the plane. The second memory module connector has a second ejector pivotally coupled to a second end of the second memory module connector about an axis perpendicular to the plane, wherein the second ejector has an upper arm extending from the pivot axis away from the printed circuit board and a lower arm extending from the pivot axis under the second slot, and wherein a distal portion of the upper arm of the second ejector lies only on a second side of the plane. The first end of the first memory module connector is separated by a narrow gap from the second end of the second memory module connector. Pivoting of the first ejector from a closed position to an open position causes the distal portion of the upper arm of the first ejector to interleave with the distal portion of the upper arm of the second ejector, and pivoting of the second ejector from a closed position to an open position causes the distal portion of the upper arm of the second ejector to interleave with the distal portion of the upper arm of the first ejector.

The printed circuit board may take any form, but is preferably a motherboard of a server or other computer or information technology equipment. Furthermore, the first memory module connector may be in a first side-by-side set of memory module connectors and the second memory module connector may be in a second side-by-side set of memory module connectors. In such a configuration, there may be multiple instances of end-to-end memory module connectors. It should be recognized that the invention may be implemented in each instance of memory module connectors that are aligned end-to-end.

The first memory module connector may be described as having a body that forms the first slot, and the first end of the first memory module connector may take the form of a tower that extends further from the printed circuit board than the body. The first ejector may have a pair of side pins that are received within mating holes in the tower to allow the first ejector to pivot about an axis perpendicular to the plane. Similarly, the second memory module connector may be described as having a body that forms the second slot, and the second end of the second memory module connector may take the form of a tower that extends further from the printed circuit board than the body. Furthermore, the second ejector may have a pair of side pins that are received within mating holes in the tower to allow the second ejector to pivot about an axis perpendicular to the plane.

The narrow gap separating the first end of the first memory module connector from the second end of the second memory module connector is preferably a distance less than 22 millimeters, and more preferably 15 millimeters or less.

Pivoting of the first ejector from a closed position to an open position causes the distal portion of the upper arm of the first ejector to interleave with the distal portion of the upper arm of the second ejector, and pivoting of the second ejector from a closed position to an open position causes the distal portion of the upper arm of the second ejector to interleave with the distal portion of the upper arm of the first ejector. The first and second ejectors may also interleave when both ejectors are in an intermediate position.

In one embodiment, the upper arm of the first ejector may include a first bumper extending toward the second ejector and aligned for engagement with the upper arm of the second ejector. Similarly, the upper arm of the second ejector may include a second bumper extending toward the first ejector and aligned for engagement with the upper arm of the first ejector. In embodiments having first and second bumpers, the first bumper preferably lies only on the second side of the plane and the second bumper preferably lies only on the first side of the plane. Alternatively, the first bumper could be made to lie only on the first side of the plane and the second bumper could be made to lie only on the second side of the plane.

One or more bumper may be implemented so that pivoting the first ejector from the closed position toward the open position will, if the second ejector is in the open position, cause the second ejector to pivot toward the closed position. Preferably, the one or more bumper may be implemented to further include the feature that pivoting the second ejector from the closed position toward the open position will, if the first ejector is in the open position, cause the first ejector to pivot toward the closed position. Most preferably, the first and second memory module connectors are arranged end-to-end with a narrow gap such that only one of the first and second ejectors can be in an open position at a time. Still further, a distal end of the upper arm of the first ejector may extend over the second end of the second memory module connector when the first ejector is in the open position, and a distal end of the upper arm of the second ejector may extend over the first end of the first memory module connector when the second ejector is in the open position.

In a further embodiment, the lower arm of the first ejector selectively assists removal of the first memory module from the first slot in response to pivoting of the upper arm of the first ejector away from the first memory module, and the lower arm of the second ejector selectively assists removal of the second memory module from the second slot in response to pivoting of the upper arm of the second ejector away from the second memory module.

In a still further embodiment, the first ejector may include a first tab extending from the upper arm of the first ejector, wherein the first tab is configured to be received into a notch in an edge of the first memory module when the first ejector is in the closed position. Similarly, the second ejector may include a second tab extending from the upper arm of the second ejector, wherein the second tab is configured to be received into a notch in an edge of the second memory module when the second ejector is in the closed position. Such a tab secures a memory module from being removed or dislodged while the corresponding ejector is in the closed position.

The upper arm of the first ejector preferably has a distal end forming a concave finger grip, and the upper arm of the second ejector preferably has a distal end forming a concave finger grip. The concave finger grip is beneficial to the ease of use of an ejector, since the gap between the first and second memory module connectors is very narrow. Accordingly, there is very little room between two installed memory modules for a user to operate the ejector and cause the upper arm of the ejector to pivot away from memory module. A concave finger grip on the distal end of the upper arm of an ejector allows a user's finger tip to push the upper arm toward the open position or the closed position. The further simplify use of the ejectors in the narrow gap between memory module connectors, a distal end of the upper arm of the first ejector preferably extends away from the printed circuit board to substantially the same elevation as a top edge of the first memory module when the first memory module is installed in the first memory module connector and the first ejector is in the closed position. Similarly, a distal end of the upper arm of the second ejector preferably extends away from the printed circuit board to substantially the same elevation as a top edge of the second memory module when the second memory module is installed in the second memory module connector and the second ejector is in the closed position.

FIG. 1 is a plan view of a server 10 with a motherboard 12 having memory module connectors 20 arranged side-by-side and end-to-end. In the example motherboard 12 as shown, the memory module connectors are arranged in four different sets 14, 15, 16, 17 of memory module connectors, with six side-by-side memory module connectors 20 in each set. Each of the individual memory module connectors in a first set 14 are aligned end-to-end with one of the individual memory module connectors in a second set 15, and each of the individual memory module connectors in a third set 16 are aligned end-to-end with one of the individual memory module connectors in a fourth set 17. A gap 18 exists between the end-to-end memory module connectors for operating ejectors 30A, 30B.

Figure 2:
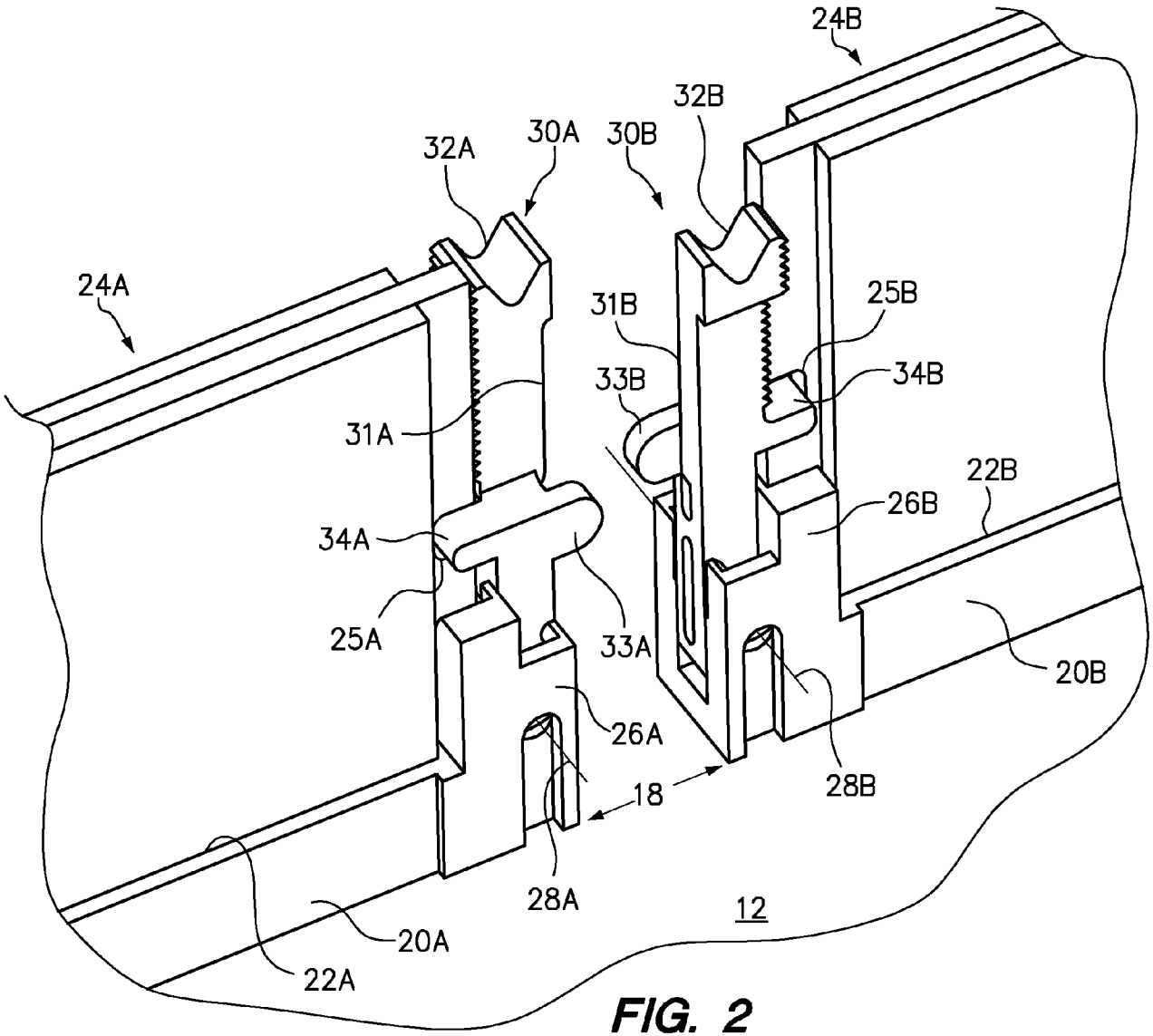
FIG. 2 is a perspective view of first and second ejector latches that facilitate close end-to-end spacing between two memory module connectors.

FIG. 2 is a perspective view of first and second ejector latches 30A, 30B that facilitate close end-to-end spacing between first and second memory module connectors 20A, 20B. In the optional embodiment shown, the first and second memory module connectors 20A, 20B, as well as the first and second ejector latches 30A, 30B, are identical to each other, but oriented 180 degrees from each other and aligned end-to-end. Accordingly, the description of a first memory module connector 20A is equally applicable to a second memory module connector 20B and the description of a first ejector latch 30A is equally applicable to a second ejector latch 30B.

The first memory module connector 20A is secured to the printed circuit board 12 and provides a slot 22A for receiving the edge of a first memory module 24A. The first memory module connector 20A also includes a tower 26A at the end of the first memory module connector 20A. The tower 26A receives and pivotally secures the first ejector latch 30A so that the first ejector latch 30A may pivot about an axis 28A between a closed/latched position (as shown) and an open/unlatched position.

The first ejector latch 30A includes an upper arm 31A extending upward from the pivot axis 28A and includes a finger grip 32A, a bumper 33A, and a tab 34A. The finger grip 32A allows a finger to easily move the upper arm 31A away from the first memory module 24A, such that the ejector latch 30A pivots from the closed position (as shown) to the open position. The bumper 33A extends toward the second ejector latch 30B and may be used to limit the range of motion of the first ejector latch 30A and push the second ejector latch 30B toward a closed position if the second ejector latch 30B was left in an open position. The interaction between the first and second ejector latches 30A, 30B is described in more detail below. A tab 34A is also provided on the upper arm 31A and extends toward the slot 22A and is positioned to align with, and be received in, a notch 25A that is formed in the edge of the first memory module 24A. Accordingly, when the first ejector latch 30A is in the closed position (as shown), the tab 34A is received in the notch 25A and prevents removal of the first memory module 24A from the first memory module connector 20A. Optionally, the first ejector latch 30A remains in the closed position under frictional forces with the tower 26A and by interference with the lower edge of the first memory module 24A (see FIG. 3A).

Figure 3A:
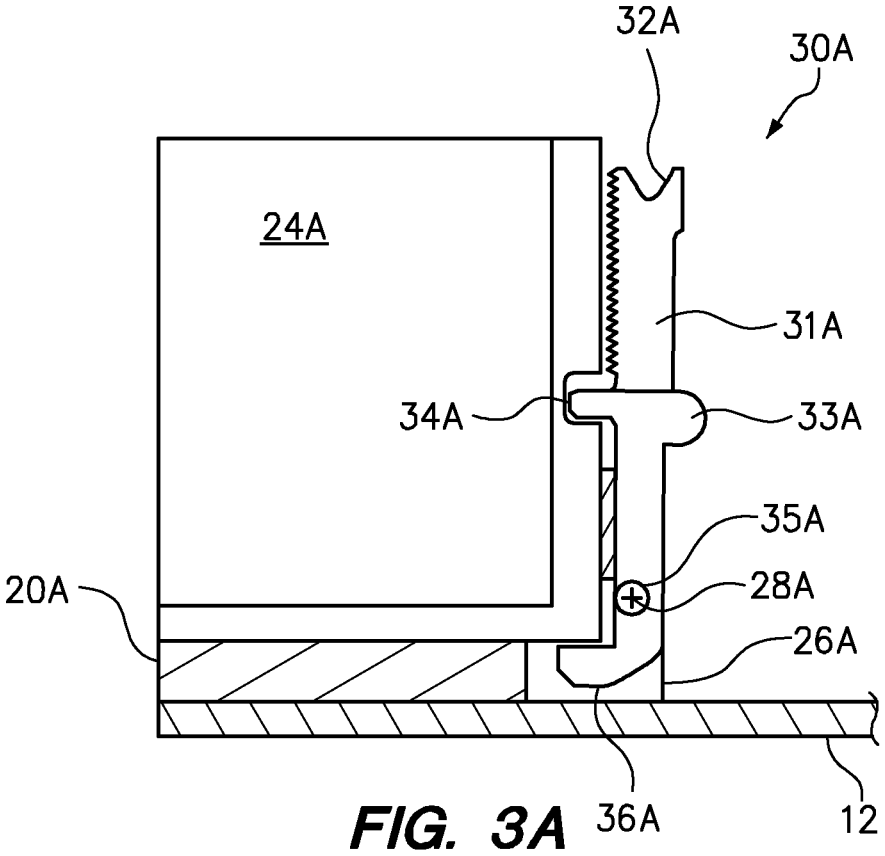
FIG. 3A is a partial cross-sectional side view of a memory module connector and ejector latch securing a memory module in electrical communication with the memory module connector.

FIG. 3A is a partial cross-sectional side view of a memory module connector 20A and ejector latch 30A securing a memory module 24A in a position for electrical communication with other components (see FIG. 1) that are also installed on the printed circuit board 12. The ejector latch 30A has a pair of opposing pins 35A that are received in mating holes within the tower 26A to allow the ejector latch 30A to pivot about the axis 28A that is defined by the position of the holes. The ejector latch 30A also includes a lower arm 36A that extends from the pivot axis 28A under the first memory module 24A. With the ejector latch 30A in the closed position of FIG. 3A, the first memory module 24A may be fully seated in the slot of the first memory module connector 20A.

Figure 3B:
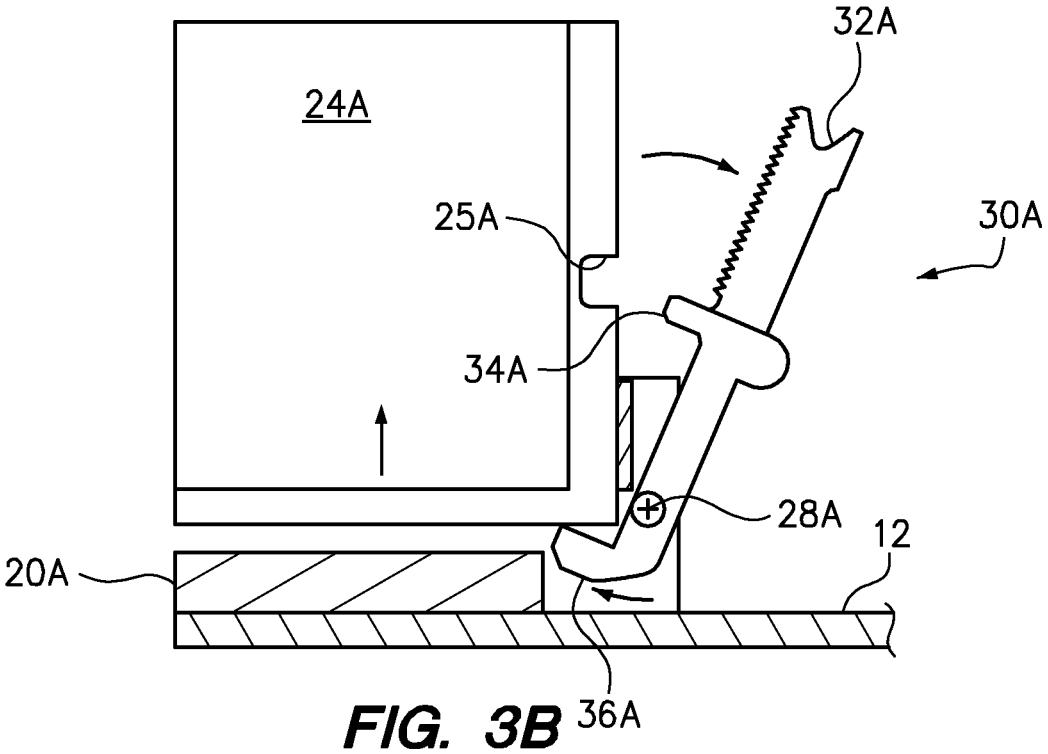
FIG. 3B is a partial cross-sectional side view of a memory module connector and ejector latch as in FIG. 3A, but with the ejector latch in an open position for installation or removal of the memory module.

FIG. 3B is a partial cross-sectional side view of the first memory module connector 20A and the first ejector latch 30A as in FIG. 3A, but with the ejector latch 30A in an open position for installation or removal of the first memory module 24A. In the open position, the tab 34A has withdrawn from the notch 25A to allow the first memory module 24A to be removed, and the lower arm 36A has lifted upward against the lower edge of the first memory module 24A. This is how the ejector latch 30A is used to assist in removing a memory module.

Figure 4A:
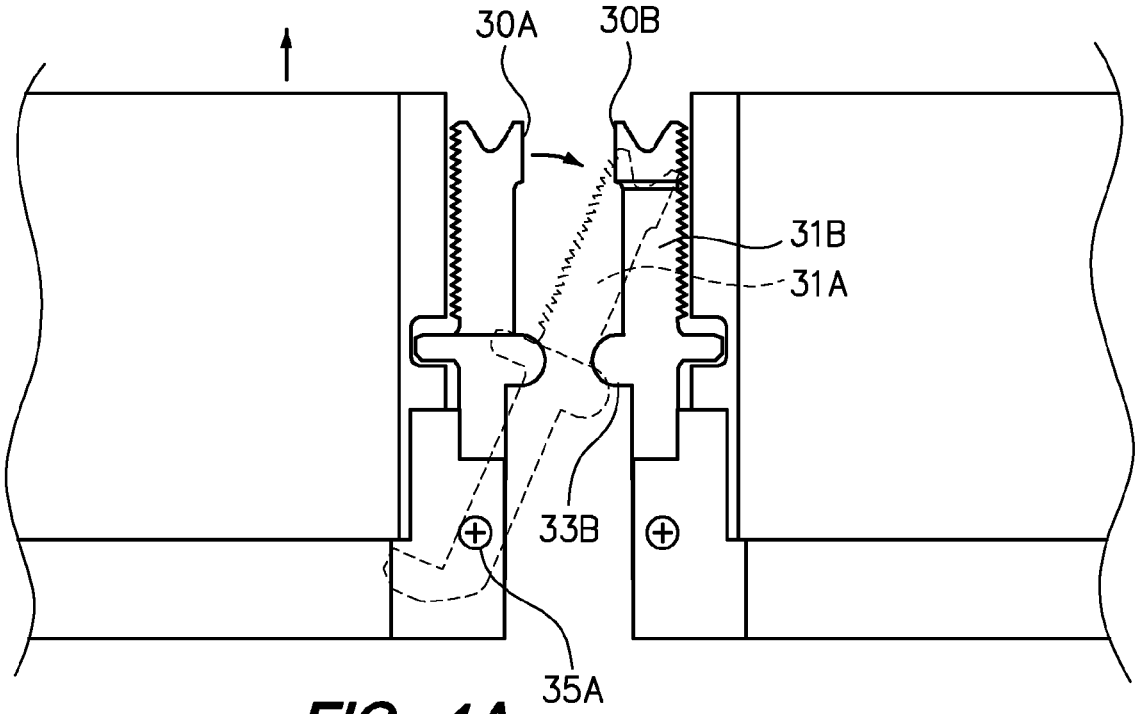
FIGS. 4A and 4B are side views of the first and second ejector latches in FIG. 2 showing how the ejector latches may be pivoted to an open position with one ejector latch interleaving with the other.
Figure 4B:
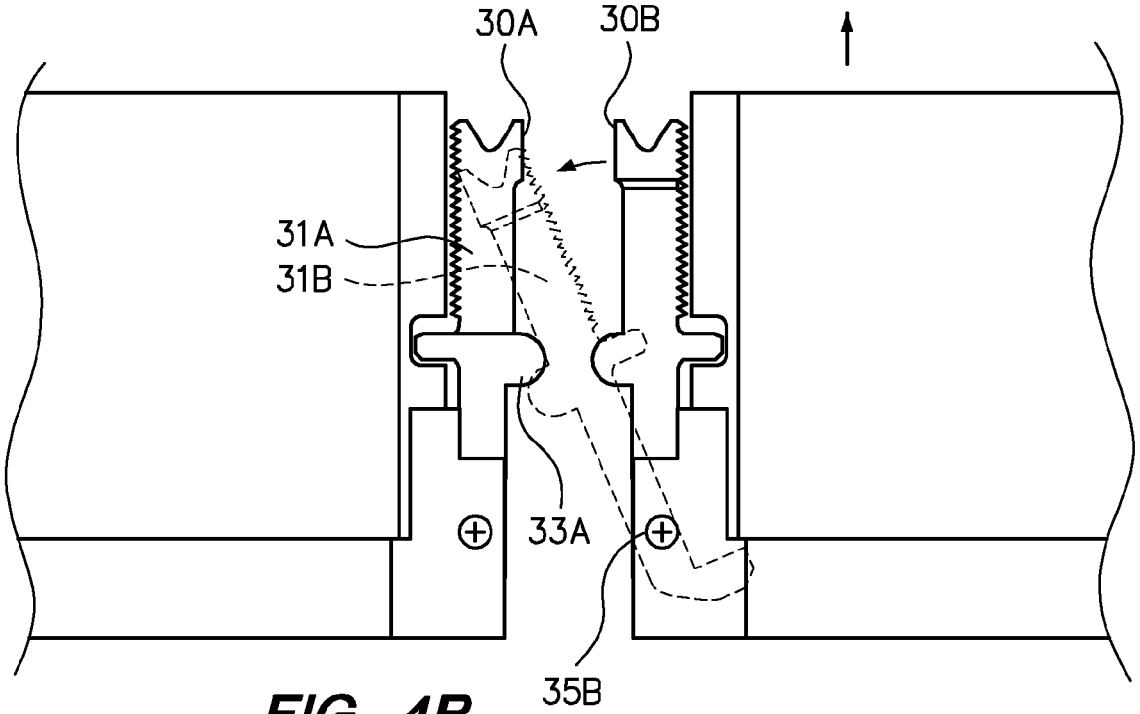

FIGS. 4A and 4B are side views of the first and second ejector latches 30A, 30B in FIG. 2 showing how the ejector latches may be pivoted to an open position with one ejector latch interleaving with the other. FIG. 4A illustrates that the first ejector latch 30A may be pivoted (clockwise, as shown) away from the first memory module 24A to an open position (shown in dashed lines). In the open position, a distal end of the upper arm 31A of the first ejector latch 30A interleaves with the upper arm 31B of the second ejector latch 30B. Aspects of the interleaving ejector latches 30A, 30B are discussed further below in reference to FIGS. 5A-B. Furthermore, the bumper 33B of the second ejector latch 30B is shown in contact with the first ejector latch 30A. Aspects of the bumpers 33A, 33B are discussed further below in reference to FIGS. 6A-D.

FIG. 4B illustrates that the second ejector latch 30B may be pivoted (counter-clockwise, as shown) away from the second memory module 24B to an open position (shown in dashed lines). In the open position, a distal end of the upper arm 31B of the second ejector latch 30B interleaves with the upper arm 31A of the first ejector latch 30A. Furthermore, the bumper 33A of the first ejector latch 30A is shown in contact with the second ejector latch 30B.

Figure 5A:
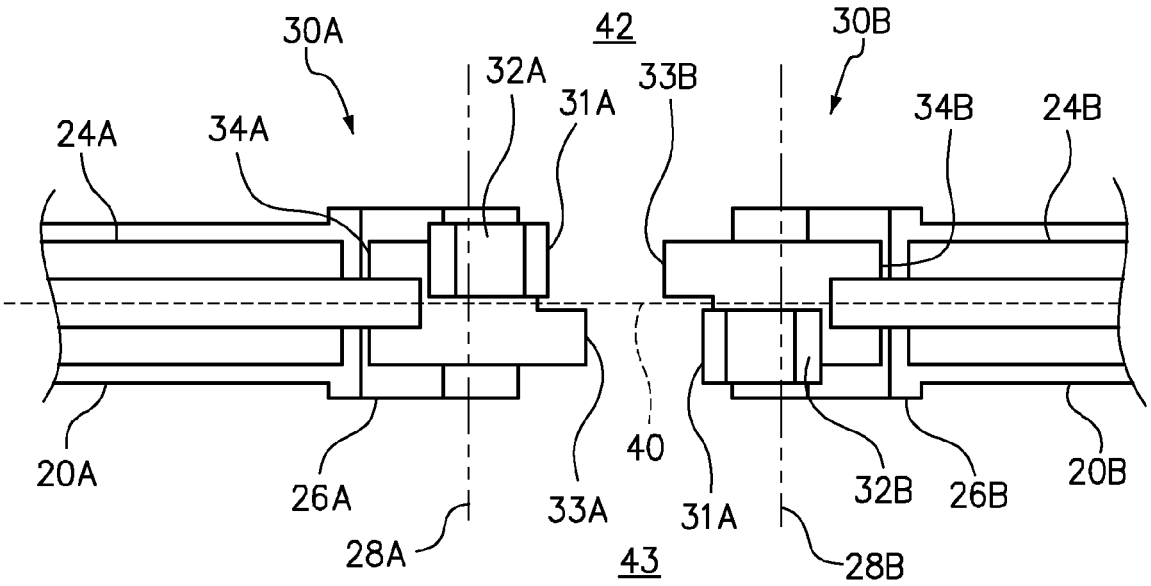
FIGS. 5A-5B are top views of the first and second ejector latches.

FIG. 5A is a top view of the first and second ejector latches 30A, 30B with both ejector latches in the closed position, consistent with FIG. 2. Accordingly, the first ejector latch 30A has its tab 34A received in the notch of the first memory module 24A to secure the first memory module in the slot of the first memory module connector 20A. Similarly, the second ejector latch 30B has its tab 34B received in the notch of the second memory module 24B to secure the second memory module in the slot of the second memory module connector 20B.

With the first and second memory module connectors 20A, 20B in end-to-end alignment, the first and second memory module connectors 20A, 20B are centered along a central plane 40 (shown in dashed lines). As a result, the first and second memory modules 24A, 24B are installed along the plane 40 and the first and second ejector latches 30A, 30B pivot about their axis 28A, 28B, respectively. The pivot axis 28A, 28B are substantially perpendicular to the plane 40, such that the first and second ejector latches 30A, 30B pivot along the plane 40.

The top view of FIG. 5A emphasizes that a distal portion of the upper arm 31A of the first ejector 30A lies only on a first side 42 of the plane 40 and a distal portion of the upper arm 31B of the second ejector 30B lies only on a second side 43 of the plane 40. Accordingly, when either of the ejectors is pivoted to an open position, the distal portions of the upper arms will not engage, but are allowed to interleave.

Preferably, the first bumper 33A lies only on the second side 43 of the plane 40 and the second bumper 33B lies only on the first side 42 of the plane 40. Accordingly, when either of the ejectors is pivoted to an open position, the bumpers will not engage each other, but are also allowed to interleave.

Figure 5B:
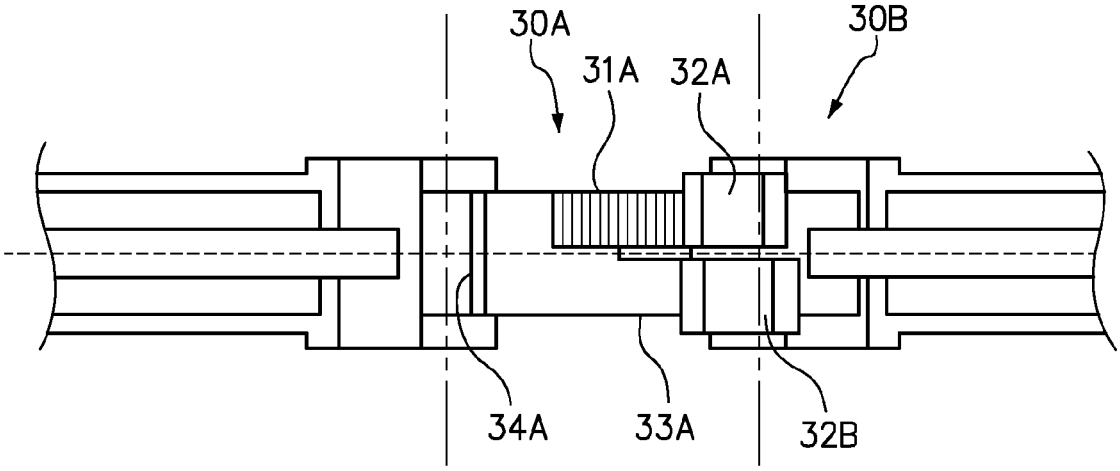

FIG. 5B is a top view similar to FIG. 5A, but showing the first ejector latch 30A in the open position, while the second ejector latch 30B remains in the closed position. FIG. 5B is consistent with FIG. 4A, when the first ejector latch 30A is in the open position (dashed lines in FIG. 4A). Note that the first and second ejector latches 30A, 30B have stayed on their original side of the plane 40 and are now interleaved.

FIGS. 6A-D are a series of side views of the first and second ejector latches 30A, 30B showing how the bumpers 33A, 33B are used to close one ejector latch as another ejector latch is opened. As shown in FIGS. 6A-D, the first memory module connector 20A is empty (i.e., it does not have a memory module installed therein) and the first ejector latch 30A is in the open position. Presumably, this situation has come about after the first ejector latch 30A has been used to assist removal of a memory module. The distal portions of the first and second ejector latches 30A, 30B are interleaved and the upper arm 31A of the first ejector latch 30A is in contact with the bumper 33B of the second ejector latch 30B.

Figure 6A:
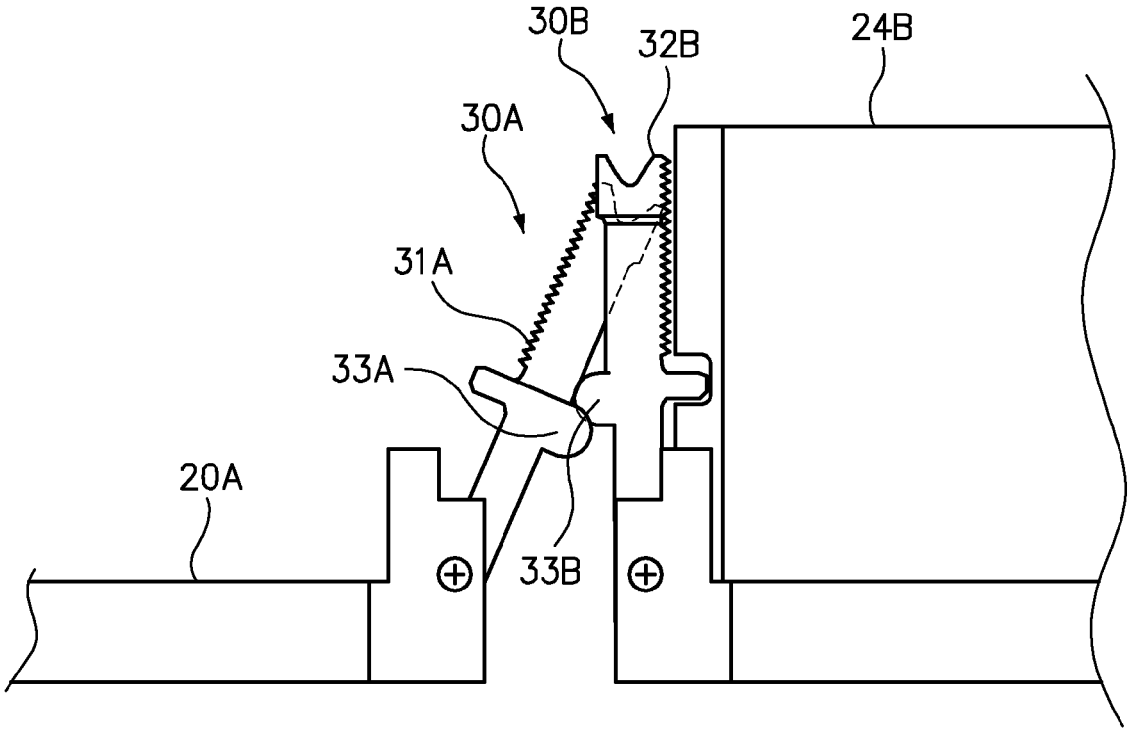
FIGS. 6A-6D are a series of side views of the first and second ejector latches showing how bumpers are used to close one ejector latch as another ejector latch is opened.

In reference to FIG. 6A, the embodiment shown makes it unnecessary to first manually close the first ejector latch 30A and then, in a separate step or motion, to manually move the second ejector latch 30B to its open position to unlatch and assist in removal of the second memory module 24B. Rather, a user may use the finger grip 32B to move the second ejector latch 30B to the open position and, in doing so, the second ejector latch 30B will push the first ejector latch 30A closed with the same motion.

Figure 6B:
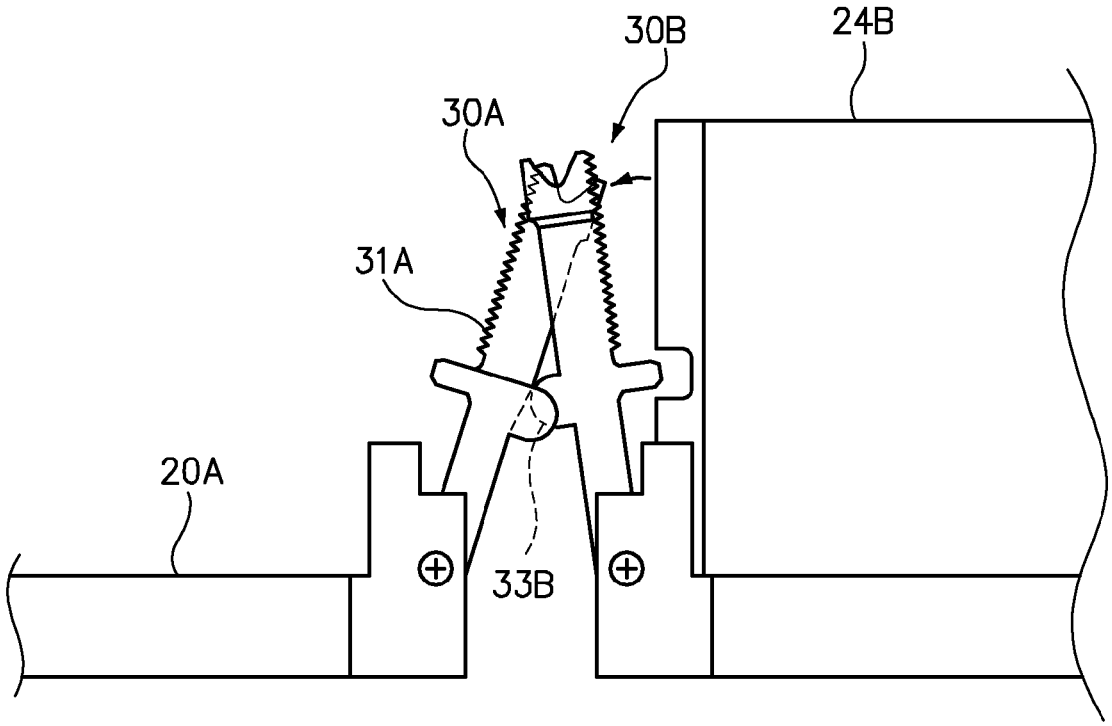

In FIG. 6B, as the second ejector latch 30B is pivoted in a direction away from the second memory module 24B, the bumper 33B (see the dashed portion behind the interleaved bumper 33A) pushes against the side of the upper arm 31A of the first ejector latch 30A. During this movement, the bumper 33B will slide downward along the side surface of the ejector latch 30A.

Figure 6C:
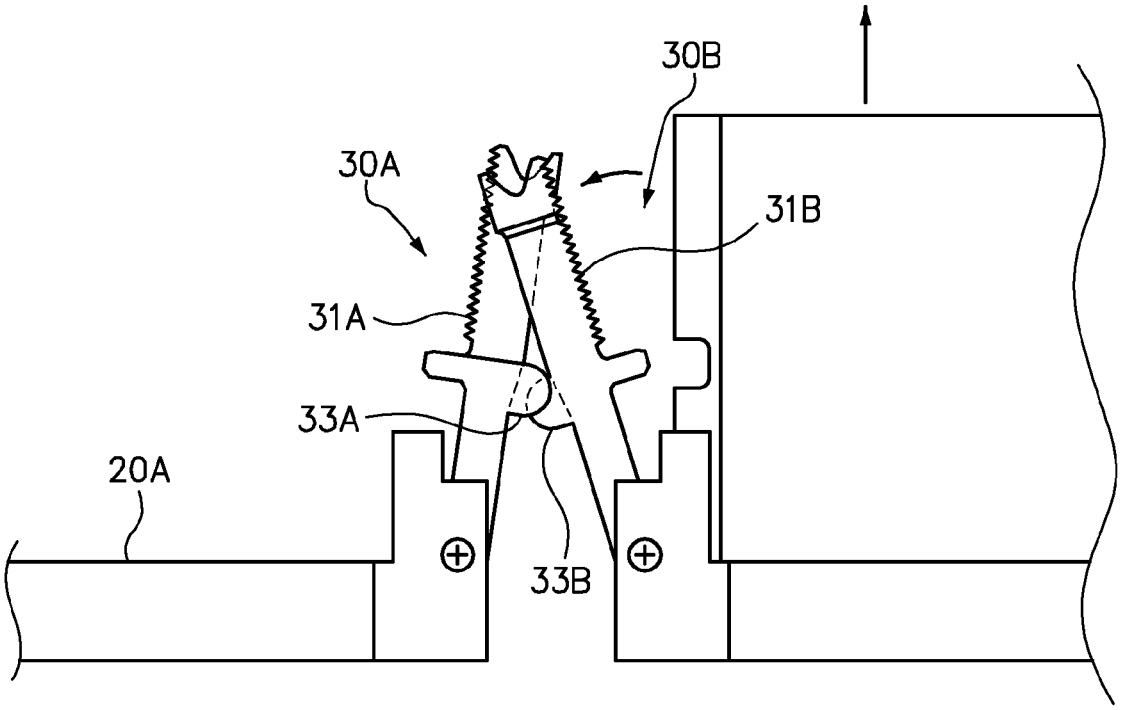

In FIG. 6C, the second ejector latch 30B continues to be manually pivoted in a direction away from the second memory module 24B, until (as shown) the bumper 33A on the first ejector latch 30A makes contact with the side of the upper arm 31B of the second ejector latch 30B and the bumper 33B on the second ejector latch 30B is no longer in contact with the side of the upper arm 31A of the first ejector latch 30A. Still further pivoting of the second ejector latch 30B to the open position (See FIG. 6D) causes the bumper 33A to slide up the side surface of the upper arm 31B of the second ejector latch 30B.

Figure 6D:
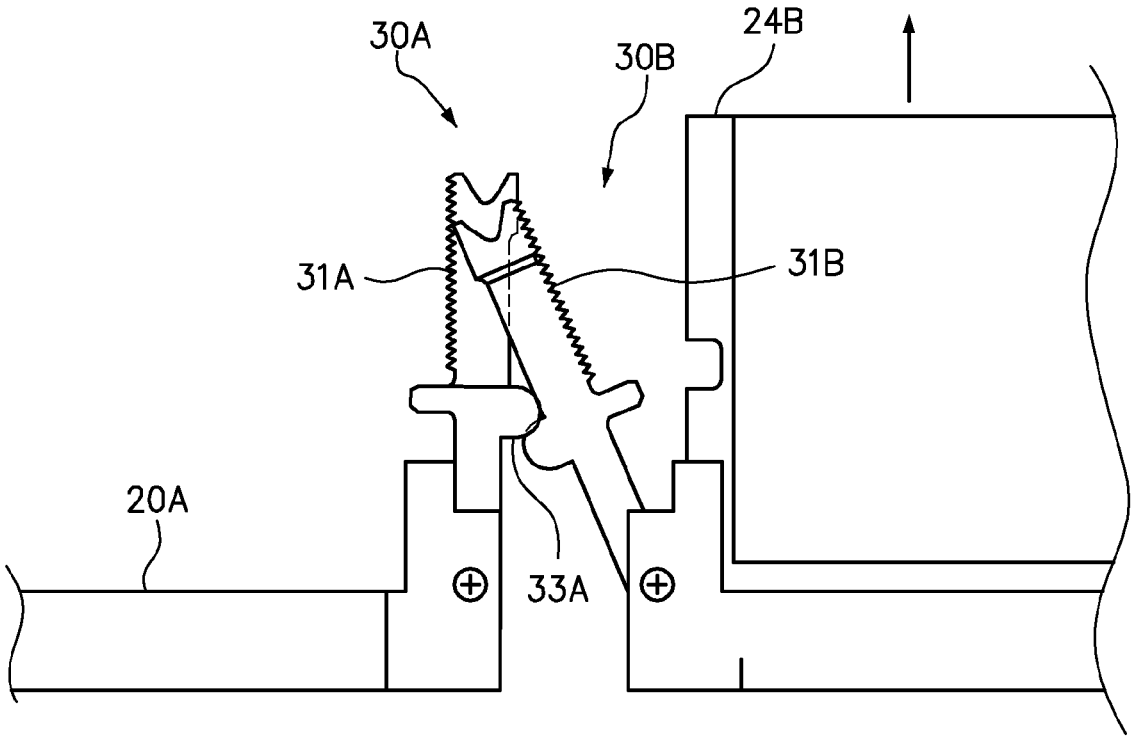

FIG. 6D shows that the second ejector latch 30B is now in the open position and the first ejector latch 30A is now in the closed position. Although not shown, the pivoting of the second ejector latch 30B has caused a lower arm (the same as lower arm 36A of the first ejector latch 30A in FIG. 3A) to lift and unseat the second memory module 24B.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An apparatus, comprising:

a printed circuit board securing first and second memory module connectors in end-to-end alignment, wherein the first memory module connector has a first slot configured to receive a first memory module and the second memory module connector has a second slot configured to receive a second memory module, and wherein the first and second memory modules are centered on a common plane;

the first memory module connector having a first ejector pivotally coupled to a first end of the first memory module connector about an axis perpendicular to the plane, wherein the first ejector has an upper arm extending from the pivot axis away from the printed circuit board and a lower arm extending from the pivot axis under the first slot, and wherein a distal portion of the upper arm of the first ejector lies only on a first side of the plane; and the second memory module connector having a second ejector pivotally coupled to a second end of the second memory module connector about an axis perpendicular to the plane, wherein the second ejector has an upper arm extending from the pivot axis away from the printed circuit board and a lower arm extending from the pivot axis under the second slot, and wherein a distal portion of the upper arm of the second ejector lies only on a second side of the plane;

wherein the first end of the first memory module connector is separated by a narrow gap from the second end of the second memory module connector, wherein pivoting of the first ejector from a closed position to an open position causes the distal portion of the upper arm of the first ejector to interleave with the distal portion of the upper arm of the second ejector, and wherein pivoting of the second ejector from a closed position to an open position causes the distal portion of the upper arm of the second ejector to interleave with the distal portion of the upper arm of the first ejector;

wherein the upper arm of the first ejector includes a first bumper extending toward the second ejector and aligned for engagement with the upper arm of the second ejector;

wherein the upper arm of the second ejector includes a second bumper extending toward the first ejector and aligned for engagement with the upper arm of the first ejector; and wherein the first bumper lies only on the second side of the plane and the second bumper lies only on the first side of the plane.

2. The apparatus of claim 1, wherein pivoting the first ejector from the closed position toward the open position will, if the second ejector is in the open position, cause the second ejector to pivot toward the closed position.

3. The apparatus of claim 2, wherein pivoting the second ejector from the closed position toward the open position will, if the first ejector is in the open position, cause the first ejector to pivot toward the closed position.

4. The apparatus of claim 1, wherein only one of the first and second ejectors can be in an open position at a time.

5. The apparatus of claim 1, wherein a distal end of the upper arm of the first ejector extends over the second end of the second memory module connector when the first ejector is in the open position.

6. The apparatus of claim 5, wherein a distal end of the upper arm of the second ejector extends over the first end of the first memory module connector when the second ejector is in the open position.

7. The apparatus of claim 1, wherein the lower arm of the first ejector selectively assists removal of the first memory module from the first slot in response to pivoting of the upper arm of the first ejector away from the first memory module, and wherein the lower arm of the second ejector selectively assists removal of the second memory module from the second slot in response to pivoting of the upper arm of the second ejector away from the second memory module.

8. The apparatus of claim 1, wherein the first ejector includes a first tab extending from the upper arm of the first ejector, and wherein the first tab is configured to be received into a notch in an edge of the first memory module when the first ejector is in the closed position.

9. The apparatus of claim 8, wherein the second ejector includes a second tab extending from the upper arm of the second ejector, and wherein the second tab is configured to be received into a notch in an edge of the second memory module when the second ejector is in the closed position.

10. The apparatus of claim 1, wherein the upper arm of the first ejector has a distal end forming a concave finger grip, and wherein the upper arm of the second ejector has a distal end forming a concave finger grip.

11. The apparatus of claim 1, wherein a distal end of the upper arm of the first ejector extends away from the printed circuit board to substantially the same elevation as a top edge of the first memory module when the first memory module is installed in the first memory module connector and the first ejector is in the closed position.

12. The apparatus of claim 1, wherein a distal end of the upper arm of the second ejector extends away from the printed circuit board to substantially the same elevation as a top edge of the second memory module when the second memory module is installed in the second memory module connector and the second ejector is in the closed position.

* * * * *